US009662694B2

(12) United States Patent
Olsson et al.

(10) Patent No.: US 9,662,694 B2
(45) Date of Patent: May 30, 2017

(54) POST-FORMING METHOD AND APPARATUS

(76) Inventors: Ashley Dean Olsson, Goulburn (AU); Ashley Norman Olsson, Goulburn (AU); Nathanael Dean Olsson, Goulburn (AU); Stafford James Olsson, Goulburn (AU)

( * ) Notice: Subject to any disclaimer, the term of this patent is extended or adjusted under 35 U.S.C. 154(b) by 0 days.

(21) Appl. No.: 14/129,072

(22) PCT Filed: Jun. 22, 2012

(86) PCT No.: PCT/AU2012/000727

§ 371 (c)(1),
(2), (4) Date: Dec. 23, 2013

(87) PCT Pub. No.: WO2012/174606

PCT Pub. Date: Dec. 27, 2012

(65) Prior Publication Data

US 2014/0124721 A1 May 8, 2014

(30) Foreign Application Priority Data

Jun. 22, 2011 (AU) ..... 2011902440

(51) Int. Cl.
*B21B 1/08* (2006.01)
*B21B 1/22* (2006.01)
(Continued)

(52) U.S. Cl.
CPC ..... *B21B 1/22* (2013.01); *B21B 1/08* (2013.01); *B21B 37/64* (2013.01); *E04H 17/00* (2013.01);
(Continued)

(58) Field of Classification Search
CPC B21B 1/08; B21B 1/085; B21B 1/092; B21B 13/103; B21B 27/024; B21B 31/22;
(Continued)

(56) References Cited

U.S. PATENT DOCUMENTS 12,837 A * 5/1855 Suffren ..... 72/224
324,867 A * 8/1885 Meatyard ..... 72/224
(Continued)

FOREIGN PATENT DOCUMENTS

AU 2249195 5/1997
CA 2137335 6/1996
(Continued)

OTHER PUBLICATIONS

"Roll Forming," Wikipedia, Published Oct. 29, 2009, pp. 1-4, available at: http://en.wikipedia.org/wiki/roll_forming.
(Continued)

*Primary Examiner* — Edward Tolan
(74) *Attorney, Agent, or Firm* — Byrne Poh LLP

(57) ABSTRACT

One aspect of the invention concerns a metallic bar or post (15) comprising a longitudinal axis; a spine (16) extending along the longitudinal axis; and at least three interconnected arms (17-19), each of which extends along the spine (16) and generally radially from the spine (16), with a free end (20-22) of each said arm (17-19) being tapered in the direction of the free end (20-22) to the spine (16). Other aspects of the invention concern a roll stand and rolling mill for forming the bar or post (15).

15 Claims, 8 Drawing Sheets

(51) Int. Cl.

| | |
|---|---|
| ***B21B 37/64*** | (2006.01) |
| ***E04H 17/00*** | (2006.01) |
| *B21B 1/092* | (2006.01) |
| *B21B 13/10* | (2006.01) |
| *B21B 27/02* | (2006.01) |
| *B21B 31/24* | (2006.01) |

(52) U.S. Cl.
CPC ..... *B21B 1/092* (2013.01); *B21B 13/103* (2013.01); *B21B 27/024* (2013.01); *B21B 31/24* (2013.01); *B21B 2261/10* (2013.01); *B21B 2275/04* (2013.01)

(58) Field of Classification Search
CPC B21B 31/24; B21B 1/16; B21B 1/163; B21B 1/18; B21B 35/02; B21B 37/46; B21B 2271/02; B21B 2271/025; B21B 2271/04; B21B 2275/02; B21B 2275/04
USPC ..... 72/100, 194, 224, 225, 226, 234, 235, 72/237, 240, 248, 249, 252.5
See application file for complete search history.

(56) References Cited

U.S. PATENT DOCUMENTS

| | | | | | |
|---|---|---|---|---|---|
| 371,424 | A * | 10/1887 | Clifford et al. | 72/224 | |
| 999,467 | A * | 8/1911 | Sack | 72/177 | |
| 1,892,608 | A * | 12/1932 | Caton | 72/225 | |
| 2,191,391 | A * | 2/1940 | Hooper | 72/224 | |
| 2,214,279 | A | 9/1940 | Kocks | | |
| 2,355,767 | A | 8/1944 | White | | |
| 2,394,183 | A * | 2/1946 | Jaecker | B21B 13/103 | 72/224 |
| 2,950,934 | A | 8/1960 | Uebing | | |
| 3,335,596 | A * | 8/1967 | Noda et al. | 72/194 | |
| 3,355,923 | A | 12/1967 | Gillet | | |
| 3,360,974 | A * | 1/1968 | Purvance | B21B 13/103 | 72/224 |
| 3,364,559 | A * | 1/1968 | O'Brien | B21B 1/08 | 15/214 |
| 3,538,732 | A * | 11/1970 | Goro et al. | 72/226 | |
| 3,746,827 | A | 7/1973 | Martin | | |
| 3,808,863 | A * | 5/1974 | Marcovitch | 72/199 | |
| 3,813,912 | A | 6/1974 | Kishikawa et al. | | |
| 3,842,635 | A * | 10/1974 | Bibighaus | B21B 21/005 | 72/208 |
| 3,952,570 | A | 4/1976 | Demny | | |
| 4,322,962 | A * | 4/1982 | Nakanishi et al. | 72/234 | |
| 4,858,457 | A | 8/1989 | Potucek | | |
| 5,085,065 | A * | 2/1992 | Onderka | B21B 37/52 | 700/151 |
| 5,092,501 | A * | 3/1992 | Potucek | A47G 25/28 | 223/85 |
| 5,144,827 | A | 9/1992 | Iio | | |
| 5,331,835 | A | 7/1994 | Palma et al. | | |
| 5,765,423 | A | 6/1998 | Cattaneo et al. | | |
| 5,953,948 | A | 9/1999 | Isozaki | | |
| 6,502,446 | B2 * | 1/2003 | Potthoff | 72/224 | |
| D587,819 | S | 3/2009 | Ryan | | |
| 7,849,723 | B2 * | 12/2010 | Cernuschi et al. | 72/224 | |
| 8,256,255 | B2 * | 9/2012 | Bosoni et al. | 72/100 | |
| 2003/0136168 | A1 * | 7/2003 | Goto | B21B 13/103 | 72/224 |
| 2011/0308197 | A1 | 12/2011 | Wallace | | |
| 2012/0328898 | A1 | 12/2012 | Strickland | | |

FOREIGN PATENT DOCUMENTS

| | | | | |
|---|---|---|---|---|
| CN | 1032691 | | 5/1989 | |
| CN | 2496570 | | 6/2002 | |
| DE | 706933 | | 6/1941 | |
| DE | 3103156 | A1 * | 8/1982 | B21B 13/103 |
| DE | 4009230 | | 5/1991 | |
| EP | 0799970 | | 10/1997 | |
| FR | 2273143 | | 12/1975 | |
| FR | 2385893 | | 10/1978 | |
| GB | 478442 | | 1/1938 | |
| GB | 660136 | A * | 10/1951 | B21B 13/103 |
| GB | 1148960 | | 4/1969 | |
| JP | 1974-033858 | | 3/1974 | |
| JP | 20038713 | | 11/2000 | |
| WO | WO9529313 | | 11/1995 | |
| WO | WO9947284 | | 9/1999 | |
| WO | WO2008154676 | | 12/2008 | |
| WO | WO2008154677 | | 12/2008 | |
| WO | WO2010037182 | | 4/2010 | |
| WO | WO/2011/020165 | | 2/2011 | |

OTHER PUBLICATIONS

Examination Report from Australian Patent Application No. 201227514, filed Jun. 22, 2012, mailed May 27, 2013.
International Preliminary Report on Patentability dated Jan. 25, 2013 in International Patent Application No. PCT/AU2012/000727.
International Search Report dated Dec. 27, 2012 in International Patent Application No. PCT/AU2012/000727.
Written Opinion dated Sep. 20, 2012 in International Patent Application No. PCT/AU2012/000727.
DEM, "Cold Rolling Cassettes", Apr. 2011, pp. 1-3.
DEM, "DEM Your Innovative Wire Rolling Partner", DEM at a Glance, 2010, pp. 6-21.
Electrostal Heavy Engineering Works, "Cold rolling tube mill P 60-160", Feb. 23, 2010, pp. 1-5, available at: http://web.archive.org/web/20100223061048/http:/www.eztm.ru/eng/products/requipment/coldroll/coldrol60160/.
Eurolls, "Product Catalogue", pp. 1-27.
European Supplementary Search Report and Opinion dated Oct. 7, 2014 in European Patent Application No. 12801900.7.
First Examination Report dated Oct. 22, 2014 in New Zealand Patent Application No. 619908.
Impianti Industriali, "Advanced Technology", pp. 1-5.
Impianti Industriali, "LTM System", pp. 1-5.
Impianti Industriali, "LTP System", pp. 1-8.
International Patent Application No. PCT/AU2012/000727, filed Jun. 22, 2012.
International Search Report dated Sep. 20, 2012 in Intnernational Patent Application No. PCT/AU2012/000727.
Notice under Section 27 dated Oct. 24, 2014 in Australian Patent Application No. 2012272514.
Notification of Futher Material Filed Under Section 27 dated Nov. 11, 2014 in Australian Patent Application No. 2012272514.
Pittini Group, "A New Steel Era", pp. 1-10.
Promills, "Rolling Cassettes and Rolls", pp. 1-13.
Written Opinion of the International Search Authority dated Sep. 20, 2012 in International Patent Application No. PCT/AU2012/000727.

* cited by examiner

POST-FORMING METHOD AND APPARATUS

TECHNICAL FIELD

This invention relates, inter alia, to a method for forming a metallic bar (or post) of the type having a central longitudinal axis and at least three interconnected arms, each of which extends along the central longitudinal axis and generally radially from the central longitudinal axis adjacent one another.

BACKGROUND ART

A Y-profile steel bar or post (ie. fencing picket as used in agriculture) typically has a spine extending along a central longitudinal axis of the bar and three lateral arms (flanges/webs) that extend both longitudinally along and generally radially from the spine. Typically, one of the arms is longer than the other two and it is this arm that usually has openings or other types of retainers for retaining fencing members such as fencing wire.

Throughout this specification the longer arm will be referred to as the 'long arm' of the bar.

A well known Y-profile steel bar/post 1 is shown in FIG. 1 and has a long arm 2 having a tapered free end 5. Such a bar 1 is typically hot rolled using a two-high mill stand 6 (ie. having upper 7 and lower 8 rolls that meet together on a horizontal plane that form the Y-shape) of a rolling mill, as shown in FIG. 2.

Problems with, and disadvantages of, rolling a steel bar using a 2-high mill stand 6 include the following:

- The long arm 2 of the bar 1 occasionally gets stuck in the upper roll 7 of the stand 6, thereby stopping production and causing damage to the roll mill. That is, when rolling the bar 1 the long arm 2 is very difficult to produce and often gets wedged in a groove 9 of the upper roll 7 and the bar 1 tends to wrap around the roll 7. This problem can be reduced by shortening the radial length of the long arm 2, or by heavily tapering the free end 5 of the long arm 2, but this profile greatly reduces the strength of the bar 1.
- The bar section has poor tolerance and finish. In order to be able to roll the long arm 2, the final (roll pass) roll stand of the mill must have a 'loose fit' around the free end 5 of the long arm 2 so that the end 5 is less likely to be grabbed and wrapped around the roll 7. This means that dimensional tolerance is poor and that the finish of the bar 1 will be rougher.
- There is premature roll (die) wear. There is a significant difference in diameter between a top of the groove 9 and a bottom of the groove 9 of the upper roll 7 through which the long arm 2 passes. As the roll 7 spins the difference in diameter equates to significant variations in surface speed. As the bar 1 passes through the rolls 7, 8 the difference in surface speed causes slippage of the rolls 7, 8 which causes them to wear very quickly.
- Due to the roll configuration and geometry only certain profile shapes are possible. Due to the roll 7, 8 configuration, the free end 5 of the long arm 2 must either be tapered or of substantially uniform thickness along the radial length of the long arm 2—but never tapered in the direction of the free end 5 to the spine 10.

All of these problems and disadvantages are currently managed by compromising either bar profile/strength, surface finish of the bar, or the efficiency of the whole profile rolling process.

DISCLOSURE OF INVENTION

It is an object of the present invention to minimise or overcome one or more of the problems or disadvantages referred to above.

According to a first aspect of the present invention, there is provided a roll stand for shaping a metallic bar of the type having a central longitudinal axis and at least three interconnected arms, each of which extends along the central longitudinal axis and generally radially from the central longitudinal axis adjacent one another, said roll stand comprising:

- a pass line along which the central longitudinal axis of the bar substantially travels; and
- roll assemblies for shaping said arms, with each said roll assembly comprising a roll having an axis of rotation and a circumferentially extending contoured rim extending between any two adjacent bar arms,
- wherein the rolls are spaced about the pass line with their said axes of rotation in a common plane and said contoured rims provide a void through which the pass line extends and shape the arms of the bar as the bar passes through the void.

According to a second aspect of the present invention, there is provided a rolling mill comprising at least one roll stand according to the first aspect of the invention.

According to a third aspect of the present invention, there is provided a method of rolling a metallic bar of the type having a central longitudinal axis and at least three interconnected arms, each of which extends along the central longitudinal axis and generally radially from the central longitudinal axis adjacent one another, said method comprising the step of passing a metallic bar through at least one roll stand, wherein the roll stand comprises:

- a pass line along which the central longitudinal axis of the bar substantially travels; and
- roll assemblies for shaping said arms, with each said roll assembly comprising a roll having an axis of rotation and a circumferentially extending contoured rim extending between any two adjacent bar arms,
- wherein the rolls are spaced about the pass line with their said axes of rotation in a common plane and said contoured rims provide a void through which the pass line extends and shape the arms of the bar as the bar passes through the void.

According to a fourth aspect of the present invention, there is provided a metallic bar formed by the roll stand according to the first aspect, the rolling mill according to the second aspect, or the method according to the third aspect.

According to a fifth aspect of the present invention, there is provided a metallic bar comprising:

- a central longitudinal axis; and
- at least three interconnected arms, each of which extends along the central longitudinal axis and generally radially from the central longitudinal axis, with a free end of each said arm being tapered in the direction of the free end to the central longitudinal axis or generally enlarged relative to an intermediate region of the arm between the free end and the central longitudinal axis.

The inventors have discovered that roll configurations other than the conventional 2-high mill stand can be used to roll furcated bars of the type having a central longitudinal axis and at least three interconnected arms, each of which extends along the central longitudinal axis and generally radially from the central longitudinal axis adjacent one another.

Advantageously, roll configurations other than that of the conventional 2-high mill stand may be used to roll a Y-profile metallic bar having a long arm, or bars of unique or differing cross section/profile.

It is to be understood that the description below equally applies to the first, second, third, fourth and fifth aspects of the invention. Features of each aspect can be features of each other aspect. For example, steps of the method according to the third aspect can be features of the roll milling according to the second aspect and vice-versa.

The metallic bar (and pre-rolled bar) may be of any suitable size and shape, and may be made of any suitable material or materials. Preferably the bar is made of metallic material such as metal or metal alloy, including steel, steel alloy, stainless steel, coated steel, anodised steel, galvanised or ungalvanised steel.

The bar may be approximately 1 m to 3 m in length (eg. about 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9 or 3.0 m), with the arms each being approximately 10 mm to 40 mm in radial length (eg. approximately 10, 15, 20, 25, 30, 35 or 40 mm), and approximately 1.5 mm to 4.0 mm in thickness (eg. approximately 1.5, 2.0, 2.5, 3.0, 3.5 or 4.0 mm). However, larger and smaller dimensions are envisaged as well. Each arm may be of varying radial length and thickness.

The bar may have any suitable profile/cross-section. In one embodiment the bar is bifurcated whereas in another embodiment the bar is trifurcated. The bar is preferably substantially Y-shaped when viewed on end. The arms may extend substantially linearly when viewed on end. The arms may be shaped to provide the bar with additional strength.

Preferably, the bar is generally Y-shaped when viewed on end, and the angle between two upstretched shorter arms of the 'Y' is between about 80 to 130 degrees (eg. about 80, 85, 90, 95, 100, 105, 110, 115, 120, 125 or 130 degrees).

Preferably, the free end of each said arm is tapered in the direction of the free end to the central longitudinal axis (spine). That is, the free end of each arm when viewed in cross-section is enlarged/bulbous relative to the intermediate part of the arm that extends between the free end the central longitudinal axis (spine). However, if desired, one or more said arms may be tapered in the opposite direction, much like traditional posts/bars, or not tapered at all.

Preferably the bar is a post, such as a fence post, and more preferably a fence post having a Y-shaped profile—a steel picket.

One or more arms of the bar may have one or more openings spaced along a length of the arm for retaining fencing members, such as fencing wire. A fencing wire may be threaded through each opening. Alternatively, each opening may be in the form of a slot for retaining a fencing wire. Preferably, these are formed in the long arm of the bar.

Alternatively or additionally, the bar may comprise keepers for fencing members as described in the applicants' co-pending applications numbered PCT/AU2008/000856, PCT/AU2008/000857 and PCT/AU2009/001316—the entire contents of which are incorporated herein by cross-reference.

The bar may comprise a pointed base that may be driven into the ground.

The roll stand may be of any suitable size, shape and construction.

The number of rolls of the roll stand will depend on the number of arms of the bar. For example, a three-armed bar would require three rolls, a four-armed bar would require four rolls, and a five-armed bar would require five rolls, and so forth.

The shape/profile of each circumferentially extending contoured rim will depend on the shape/profile that the arm is to have. For example, for a general Y-profile bar/post 1 as shown in FIG. 1 (or X-shaped post), each contoured rim may be of a general V-shape/wedge shape when viewed in radial cross section. Each contoured rim may have circumferentially extending outer flanges (raised/proud edges) bordering a circumferentially extending inner recessed region having an apex. That is, the inner recessed region having the apex may be substantially V-shaped/wedge-shaped when viewed in radial cross section.

The outer flange/raised edge height may determine the thickness of the free end of one radial half of an arm. The flange/raised edge height together with the inner recessed region having the apex may determine the shape and width of radial halves of two adjacent arms as the contoured rims provide the void. Generally speaking, the greater the distance between adjacent inner recessed regions, the greater the void and the thicker the arms. Generally speaking, the greater the distance between the apexes and the pass line, the thicker the spine where the arms intersect one another.

In order to form a bar arm with a bulbous/enlarged region on one radial half of the arm or to form a bulbous/enlarged region at the central longitudinal axis (spine) where two adjacent arms intersect, the inner recessed region located between the outer flanges may have a least one circumferentially extending groove.

For example, a circumferentially extending groove located in the inner recessed region adjacent each outer flange may produce two radial half arms each having a bulbous/enlarged region at the free end thereof.

For example, a circumferentially extending groove located in the apex of the inner recessed region can produce a bulbous/enlarged region where two adjacent arms intersect at the central longitudinal axis (spine).

For example, a circumferentially extending groove located in the inner recessed region adjacent each outer flange and a circumferentially extending groove located in the apex of the inner recessed region may produce two radial half arms each having a bulbous/enlarged region at the free end thereof as well as a bulbous/enlarged region where the two arms intersect at the central longitudinal axis (spine).

For example, in order to form a bar whereby each arm has a bulbous/enlarged free end, each roller may have a circumferentially extending groove located in the inner recessed region adjacent each outer flange. In order to produce a bar whereby the free end of each said arm is less bulbous yet tapered in the direction of the free end to the central longitudinal axis (spine), each circumferentially extending groove located adjacent each outer flange may be of greater width and of decreasing depth in the direction from the outer flange to the apex.

It is to be understood that the contoured rims in the examples mentioned above may generally be used in combination to produce bars with arms of virtually any number of different profiles, shapes, widths, thicknesses and cross sections etc, and each arm of a bar may differ from the others or all arms of the one bar may be substantially the same.

The roll stand may comprise a housing for containing the rolls and the housing may be of any suitable size, shape and construction. The housing may have a front wall having an inlet for the bar. The housing may have a rear wall having an outlet for the bar, and the pass line may extend centrally through the inlet and outlet. The inlet and outlet may be shaped so as to allow the rolls to extend partway there through.

Each roll assembly may comprise a drive shaft extending from the roll and at least one bearing through which the shaft extends. The drive shaft may be of any suitable size, shape and construction. The drive shaft may be keyed or otherwise connected to a drive of sorts, eg. a motor. Any suitable type of bearing may be used, e.g. plain bearing, roller bearing or ball bearing. Preferably, a bearing is located each side of the roll and a drive shaft extends from the roll through the bearings.

Each roll assembly may comprise a roll positioner for positioning each roll within the housing relative to the pass line. The positioner may be of any suitable size, shape and construction. In a preferred embodiment, the positioner is a clamp assembly extending from a bearing located either side of the roll and connected to the housing by way of screws. The clamp assembly may comprise position adjusting screws that may allow the roller to be moved incrementally towards or away from the pass line so as to change the size of the void.

The rolling mill preferably comprises a plurality of roll stands arranged in sequence, each of which has rolls having specifically contoured rims for incrementally forming/shaping the arms. Cold profile rolling or hot profile rolling may be employed. Likewise, the method according to the third aspect may comprise the step of passing the bar through a plurality of roll stands arranged in sequence, each of which has rolls having specifically contoured rims for incrementally forming/shaping the arms.

The rolling mill may comprise a pre-cut die or a post-cut die for cutting the bar to length. Similarly, the rolling mill may comprise a pre-cut die or a post-cut die for forming the pointed ground anchoring base of the bar. Likewise, the method according to the third aspect may comprise the step of passing the bar through a pre-cut die or a post-cut die for cutting the bar to length. Likewise, the method according to the third aspect may comprise the step of passing the bar through a pre-cut die or a post-cut die for forming the pointed ground anchoring base of the bar.

The rolling mill may comprise a punch for punching openings in the bar. Punching may occur before roll forming starts, during roll forming or after roll forming has been completed. Likewise, the method according to the third aspect may comprise the step of punching openings in the bar.

The rolling mill may have a baking line or a galvanisation line. The bar may be treated so as to reduce or prevent corrosion. This may be achieved in any suitable way. For instance, the bar may be coated, plated or otherwise treated for corrosion prevention before roll forming starts, during roll forming or after roll forming has been completed. Likewise, the method according to the third aspect may comprise the step of treating the bar by way of baking or galvanisation.

Preferred embodiments of the invention will now be described by way of example with reference to the accompanying figures.

BEST MODES FOR CARRYING OUT THE INVENTION

Figure 2:
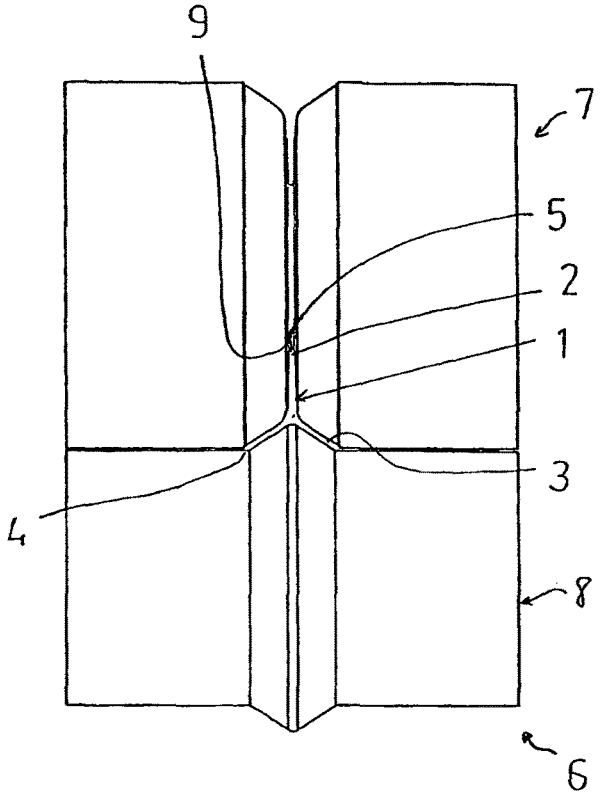
FIG. 2 shows part of a 2-high mill stand for rolling the post of FIG. 1.

In the figures, like reference numerals refer to like features.

Figure 1:
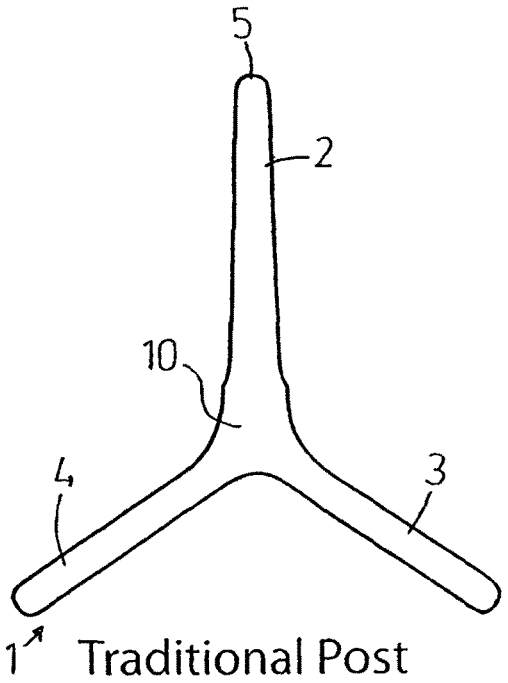
FIG. 1 shows the profile of a known Y-profile steel post (bar)

Referring first to FIG. 1, there is shown a known furcated Y-profile steel post 1 (bar 1). The post 1 has a spine 10, a central longitudinal axis extending along the spine 10 and three lateral arms (flanges) 2, 3, 4 that extend along a length of the spine 10 and generally radially from the spine 10. Arms 3 and 4 extend from the spine 10 at approximately 100-120 degrees relative to one another. Arm 2 is longer than arms 3 and 4 and a free end 5 of the arm 2 is tapered.

FIG. 2 shows part of a two-high mill stand for rolling the post 1 of FIG. 1 and has an upper roll 7 and a lower roll 8.

Figure 3:
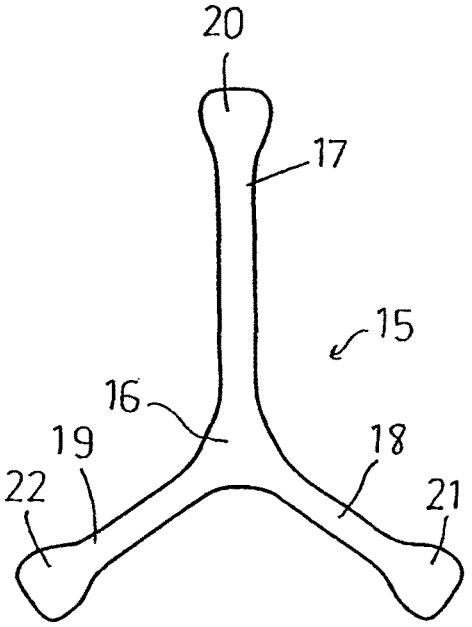
FIG. 3 is an end view (profile/cross section) of a post (bar), according to an embodiment of the present invention.
Figure 5:
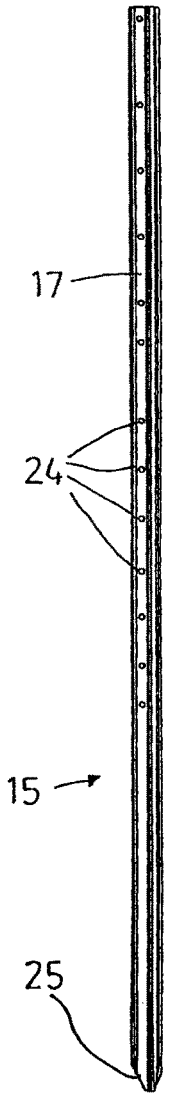
FIG. 5 is a side elevation view of the post of FIG. 4.
Figure 4:
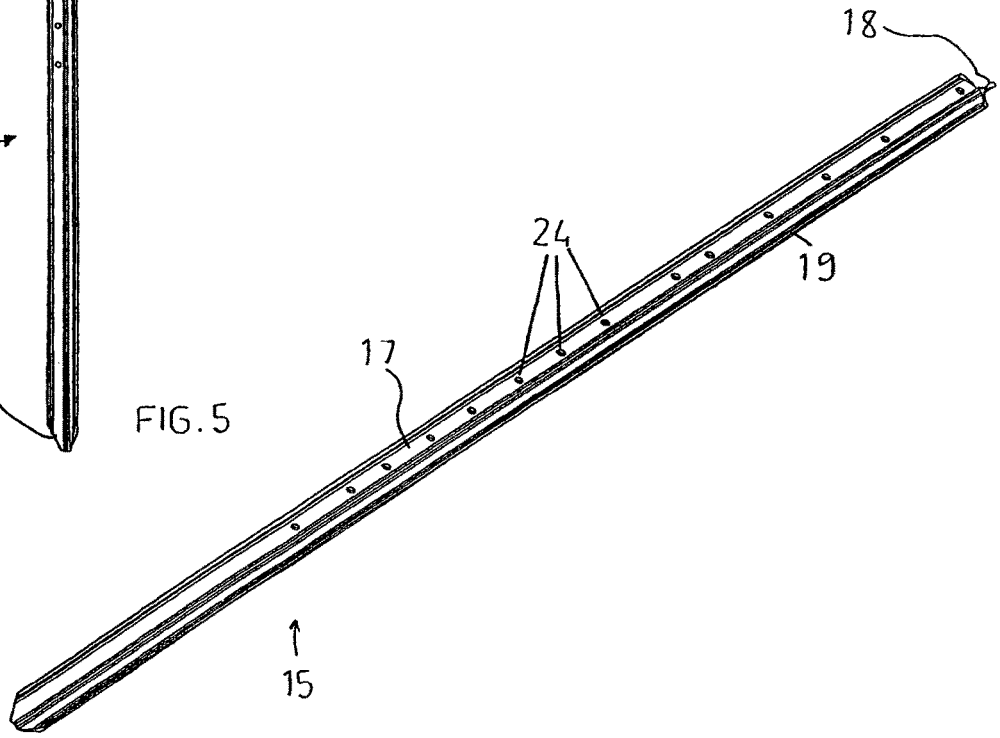
FIG. 4 is a perspective view of the post shown in FIG. 3.

Referring now to FIGS. 3-5, there is shown a furcated Y-profile steel post 15 (bar 15) according to an embodiment of the present invention. The post 15 has a spine 16, a central longitudinal axis extending along the spine 16 and three arms 17, 18, 19 that extend along a length of the spine 16 and generally radially from the spine 16. Arms 18 and 19 extend from the spine 16 at approximately 100-120 degrees relative to one another. Arm 17 (long arm 17) is longer than arms 18 and 19. A free end 20-22 of each arm 17-19 is enlarged/bulbous 20-22 relative to an intermediate region of the arm 17-19 extending between the free end 20-22 and spine 16. Such a post 15 profile and like profiles cannot be produced by the conventional 2-high mill stand shown in FIG. 2.

As seen in FIGS. 4 and 5, the long arm 17 has openings 24 spaced along a length of the arm 17 for retaining fencing wires and other types of fencing members. The post 15 also has a pointed ground anchoring end 25, as seen in FIG. 5.

Referring now to FIGS. 6-9, there is shown a roll stand 30 for a rolling mill, for forming the post 15 shown in FIGS. 3-5. The roll stand 30 includes a housing 31 (see FIG. 6), a pass line 11 (see FIG. 9), a void 12 and three roll assemblies 32-34.

Each roll assembly 32-34 includes a roll 37-39 having an axis of rotation and a circumferentially extending contoured rim 40-42 for forming/shaping said arms 17-19. The post arms 17-19 are shown in phantom/outline. The rolls 37-39 are spaced about the pass line 11 with their axes of rotation in a common plane and with their contoured rims 40-42 providing the void 12 through which the pass line 11 extends. The rolls 37-39 extend generally radially relative to the pass line 11 at about 120 degrees relative to one another. The contoured rim 40-42 of each roll 37-39 forms/shapes radial halves of two adjacent arms 17-19.

Figure 13:
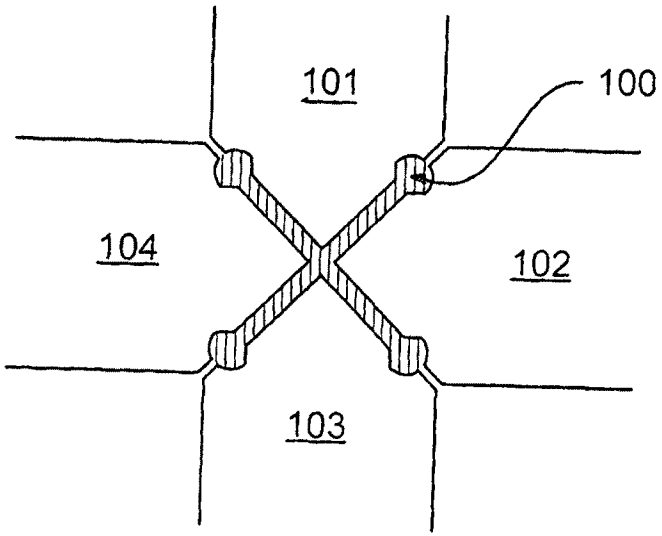
FIG. 13 is a radial cross sectional view of four rolls of a roll stand and a four-armed bulbous post, according to another embodiment of the present invention.

The number of rolls of the roll stand will depend on the number of arms of the bar/post. For example, a three-armed post like post 15 would require three rolls, a four-armed bar like post 100 of FIG. 13 (shown with cross hatching) would require four rolls 101-104, and a five-armed post would require five rolls, and so forth.

Figure 10:
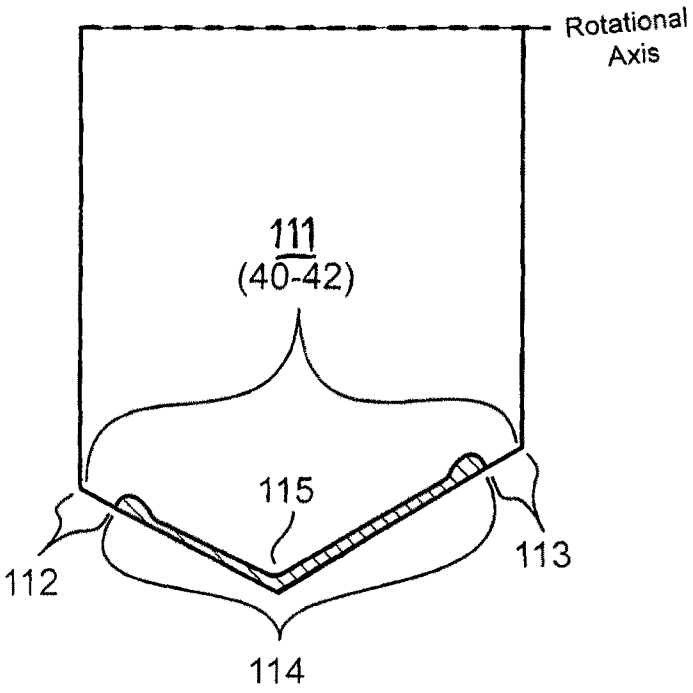
FIG. 10 is a general cross sectional view of part of a roll of a roll assembly, according to an embodiment of the present invention.
Figure 9:
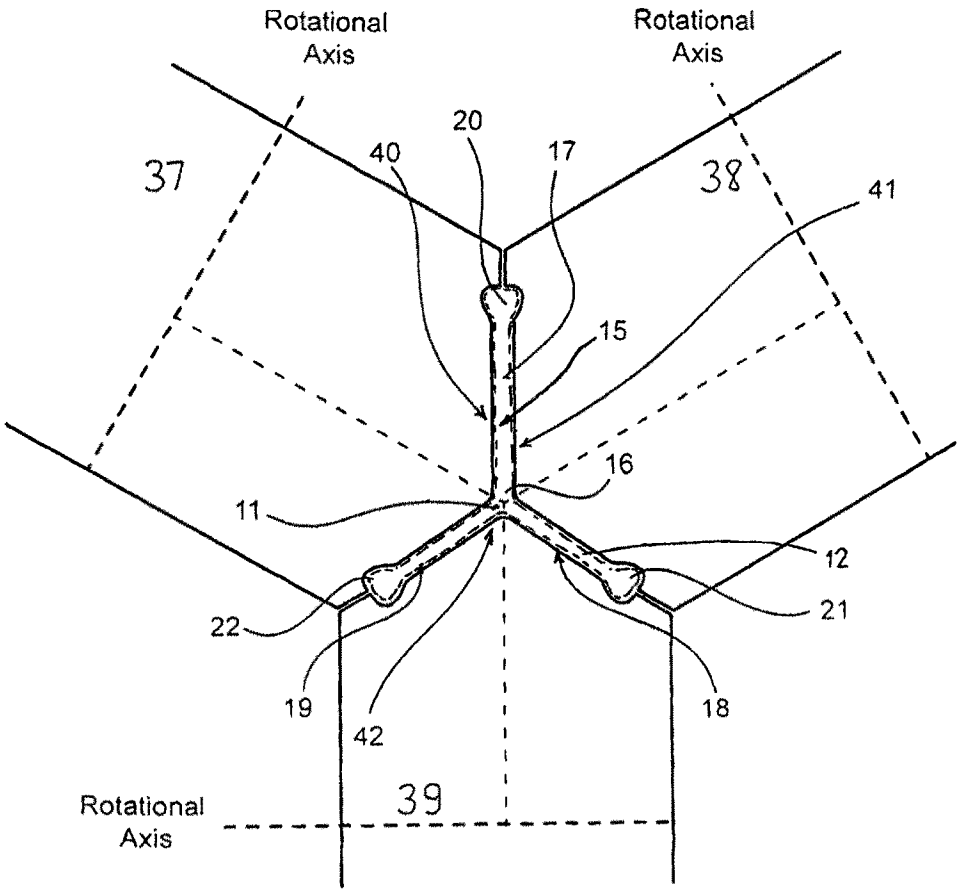
FIG. 9 is a cross sectional view of three rolls of three roll assemblies of the roll stand of FIG. 6 and the post of FIG. 3 (shown in phantom), according to an embodiment of the present invention.

Referring now to the general depiction of a rim 111 (40-42) in FIG. 10, the shape/profile of each contoured rim 111 (40-42) will depend on the shape and thickness that the post arm is to have. Each contoured rim 111 (40-42) has circumferentially extending outer flanges 112, 113 (raised/proud edges) bordering a circumferentially extending inner recessed region 114 (shown with cross hatching) having an apex 115. That is, the inner recessed region 114 having the apex 115 is substantially V-shaped/wedge-shaped when viewed in radial cross section.

The outer flange 112, 113 (raised edge) height determines the thickness of the free end of one radial half of an arm. The flange 112, 113 height together with the inner recessed region 114 having the apex 115 determines the shape and thickness of radial halves of two adjacent arms. The greater the distance between adjacent inner recessed regions 114, the greater the void and the thicker the arms. The greater the distance between the rim apexes 115 and the pass line, the thicker the spine where the arms intersect one another.

Figure 11:
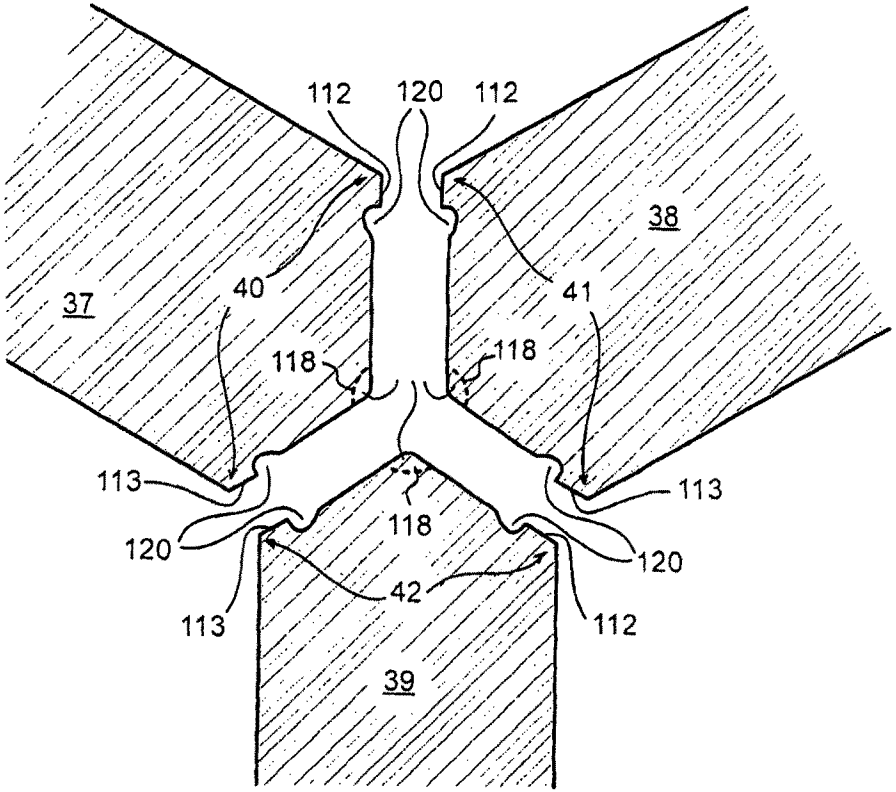
FIG. 11 is a partly exploded cross sectional view of three rolls of three roll assemblies of the roll stand of FIG. 6, according to an embodiment of the present invention.

As seen in FIG. 11, for the post of FIG. 3, the contoured rim 40-42 of each roller 37-39 has a circumferentially extending groove 120 located in the inner recessed region (not labelled) adjacent each outer flange 112, 113. A circumferentially extending groove 118 located in the apex 115 of the inner recessed region 40-42 can produce a bulbous/enlarged region 118 where two adjacent arms intersect at the central longitudinal axis (spine).

Figure 12:
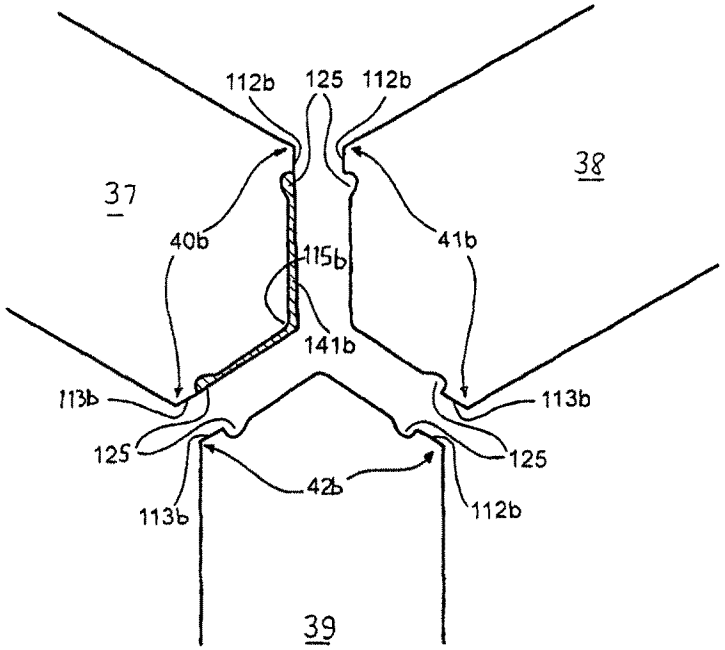
FIG. 12 is a partly exploded cross sectional view of three rolls of three roll assemblies, according to an embodiment of the present invention.

As seen in FIG. 12, for a post whereby the free end of each arm is less bulbous/enlarged yet tapered in the direction of the free end to the central longitudinal axis (spine), each circumferentially extending groove 125 located adjacent each outer flange 112*b*, 113*b* (of each contoured rim 40*b*-42*b*) can be of greater width and of decreasing depth in the direction from the outer flange 112*b*, 113*b* to the apex 115*b*.

Figure 6:
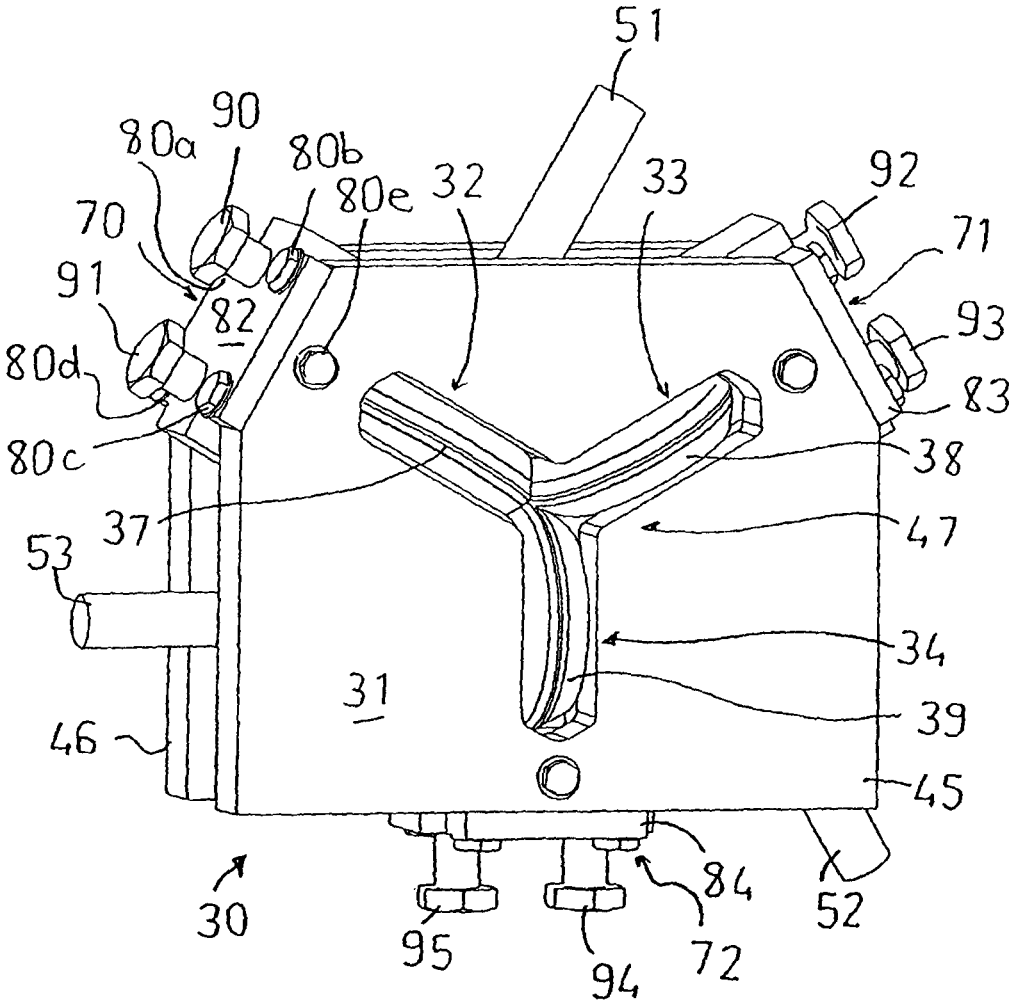
FIG. 6 is a perspective view of a roll stand for forming the post of FIG. 3, according to an embodiment of the present invention.
Figure 7:
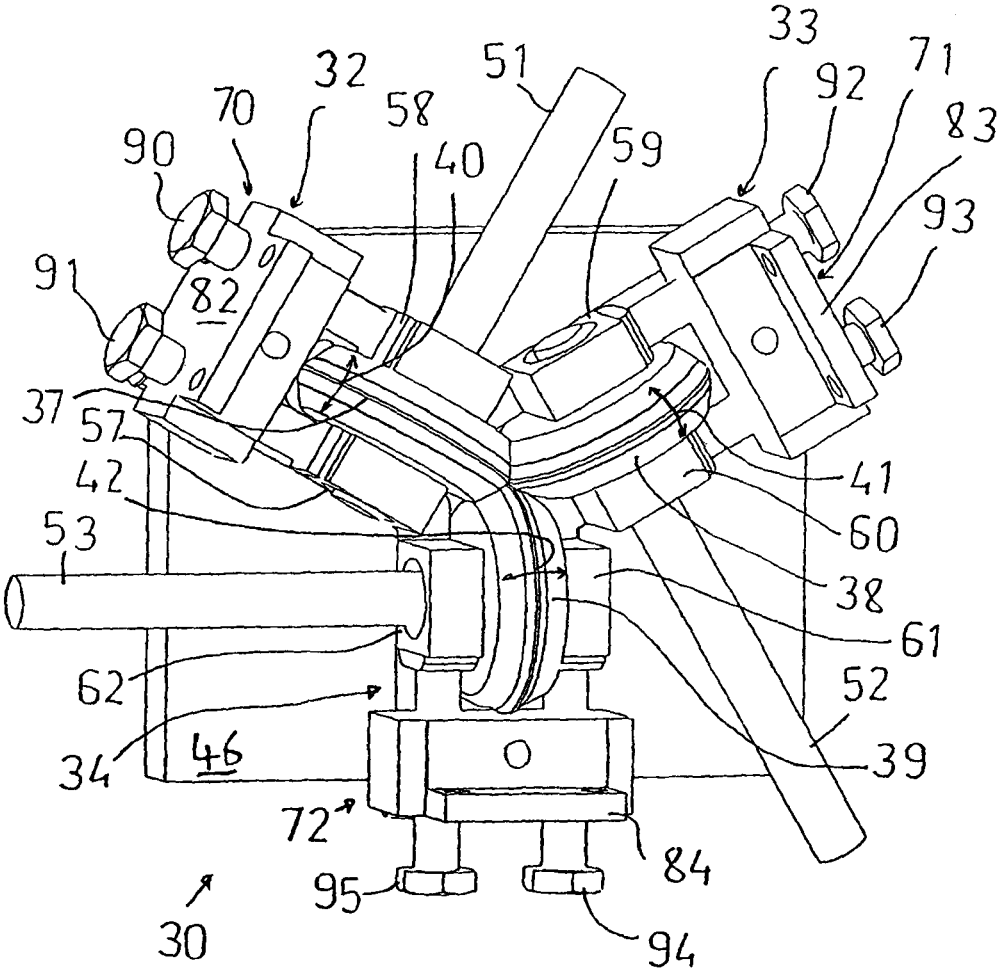
FIG. 7 is a perspective view of part of the roll stand of FIG. 6.

As seen in FIG. 6, the housing 31 has a front plate wall 45 having a Y-shaped inlet 47 for the post and a rear plate wall 46 having a Y-shaped outlet (not shown) for the post 15. The pass line 11 extends through a centre of the inlet 47 and outlet. The inlet 47 and outlet are shaped so as to allow the rolls 37-39 to extend partway there through, as shown in FIG. 6.

Each roll assembly 32-34 includes a drive shaft 51-53 extending from the roll 37-39 and a pair of bearing blocks 57-62 through which the shaft 51-53 extends. Ends of the shafts 51-53 are keyed to a respective drive in a conventional way, such that the rotational speeds of the rolls 37-39 can be varied as required (e.g. when rolls of differing diameter are used).

Figure 8:
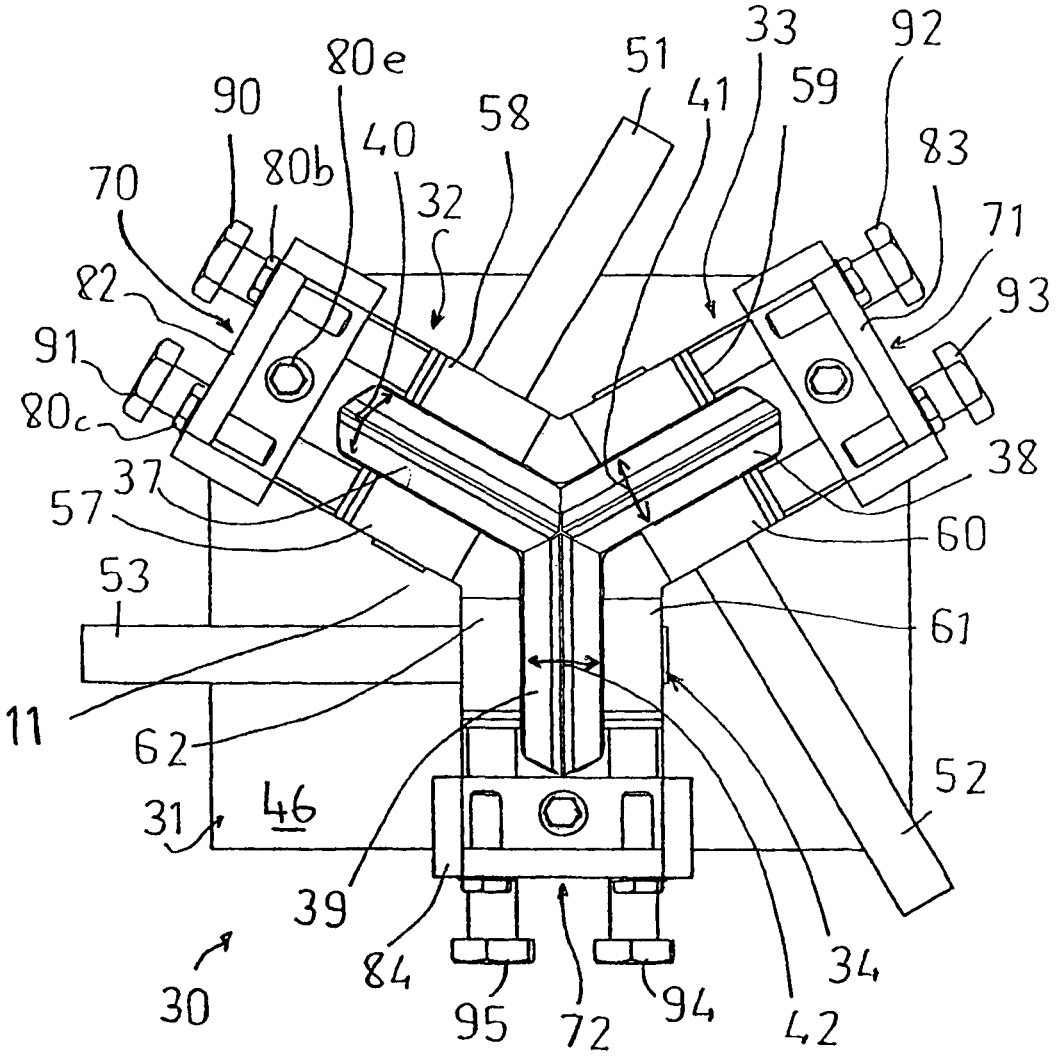
FIG. 8 is an elevation view of part of the roll stand of FIG. 6.

Each roll assembly 32-34 includes a clamp assembly 70-72 extending from the bearing blocks 57-62. The clamp assemblies 70-72 hold the rolls 37-39 in the correct position within the housing 31 relative to the pass line 11. Each clamp assembly 70-72 is connected to the housing plate walls 45, 46 by way of a body 82-84 and screws 80*a*, 80*b*, 80*c*, 80*d*, 80*e* that extend through the body 82-84 (only some of which have been labeled) as seen in FIGS. 6 and 8.

Each clamp assembly 70-72 includes a pair of position adjusting screws 90-95 for adjusting the position of the rolls 37-39 relative to the pass line 11. A shaft of each screw 90-95 is externally threaded and extends through the body 82-84. A head of each screw 90-95 is located one side of the body 82-84 and the other end of each screw 90-95 is fastened to a bearing block 57-62, as seen in FIG. 8. Turning the screws 90-95 in a first direction moves the rolls 37-39 incrementally towards the pass line 11 and turning the screws 90-95 in a second opposite direction moves the roll 37-39 incrementally away from the pass line 11. In this way, the positioning of the rolls 37-39 can be individually readjusted when required—e.g. when a roll is worn.

The rolling mill may utilise cold profile rolling or hot profile rolling. The rolling mill will typically be a normal mill set up but comprising a plurality of roll stands like stand 30 arranged in sequence, each of which have rolls having specifically contoured rims for forming the arms of the post 15 in a step-by-step manner. Normally the contours would be designed with the aid of a computer.

Figure 14:
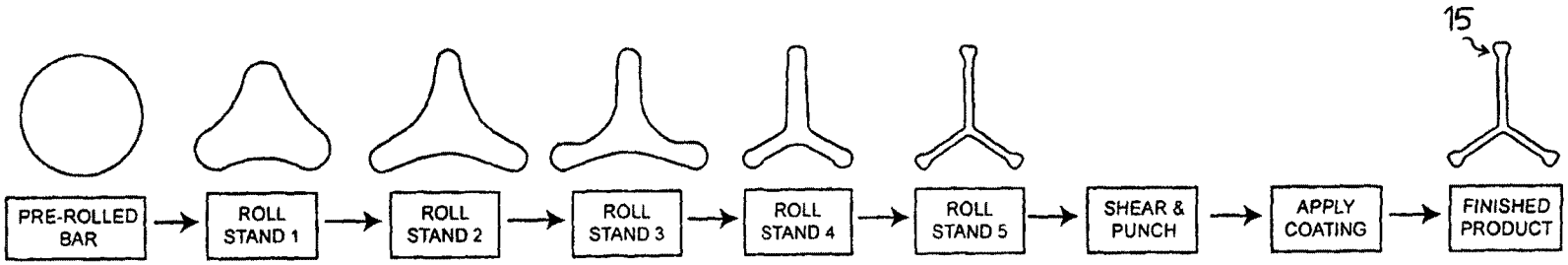
FIG. 14 is a schematic showing processing steps of a metallic bar in a roll mill to form the post as shown in FIGS. 3-5.

As generally depicted in FIG. 14, in order to manufacture a post/bar like post 15 (or even post 1), a steel pre-rolled bar/post is fed sequentially through roll stands like stand 30 of the mill, until a post 15 of the desired profile is achieved. Since arm 17 is longer than the other two arms 18, 19—which means that the profile is not "triangularly symmetrical"—the rolling speed of each roll 37-39 will need to be adjusted accordingly.

The post 15 may be cut to the required length using a die/flying shear system to form the post 15 or a longer intermediate post.

The post 15 may be further processed by way of being cut to produce the ground anchoring point 25. The post 15 may be hole- or slot-punched using a punch of the roll mill. The post 15 may be subjected to anti-corrosion techniques (eg. coated, plated, anodised etc) using a baking or galvanisation line. These steps are generally depicted in FIG. 14.

Some of the advantages of the present invention include the following:

- The long arm of the bar/post is less likely to get stuck in the rolls of the roll stand. Hence, the radial length of the long arm need not be shortened, nor heavily tapering.
- The post section can have extremely good dimensional tolerance and finish.
- Premature roll (die) wear is less likely, and worn rolls can be utilised by altering their position and rotational speed.
- A greater degree of profile shape design is possible due to the roll geometry and configuration.
- The 3-roll design of the roll stand enables the Y-shaped profile to be formed with fewer roll stands arranged in sequence.
- The profiles having enlarged/bulbous free ends increase the strength of the post as well as the strength to weight ratio—thereby reducing the cost of the post and increasing strength, without reducing the surface area holding strength in the soil.

The foregoing embodiments are illustrative only of the principles of the invention, and various modifications and changes will readily occur to those skilled in the art. The invention is capable of being practiced and carried out in various ways and in other embodiments. It is also to be understood that the terminology employed herein is for the purpose of description and should not be regarded as limiting.

The term "comprise" and variants of the term such as "comprises" or "comprising" are used herein to denote the inclusion of a stated integer or stated integers but not to exclude any other integer or any other integers, unless in the context or usage an exclusive interpretation of the term is required.

The invention claimed is:

1. A method of rolling a bar consisting of steel or alloy steel, wherein said method comprises the step of passing the bar consisting of steel or alloy steel through at least one roll stand configured to roll a bar consisting of steel or alloy steel to thereby form a rolled bar, wherein the rolled bar has a central longitudinal axis and three interconnected arms, each of which extends along the central longitudinal axis and generally radially from the central longitudinal axis adjacent one another, and wherein each of said three interconnected arms are from 2.0 mm to 4.0 mm thick, wherein the roll stand comprises:

only three roll assemblies for shaping said arms, with each said roll assembly comprising:

a roll having an axis of rotation and a circumferentially extending contoured rim extending between any two adjacent bar arms, a roll positioner for moving the roll towards or away from the pass line, and a drive shaft extending from the roll;

wherein the roll assemblies define a pass line along which the central longitudinal axis of the bar substantially travels; and wherein the rolls are spaced about the pass line with their said axes of rotation in a common plane and said contoured rims provide a void through which the pass line extends and shape the arms of the bar as the bar passes through the void, and wherein the roll positioners are capable of moving the rolls incrementally within the common plane and along an axis perpendicular to the axis of rotation of each said roll so as to change the size of the void; and wherein the rolls abut each other to thereby encapsulate the bar as it passes through the void; and wherein the method comprises the step of varying the rotational speed of at least one roll within any one roll stand independently of the rotational speed of another roll within the any one roll stand; and wherein the at least one roll stand is a plurality of roll stands arranged in sequence, wherein the rolls of each of said roll stands have circumferentially extending contoured rims adapted to incrementally form the three interconnected arms of the rolled bar.

2. The method of claim 1, wherein at least one of said contoured rims is shaped to form a said arm generally tapered in the direction from a free end of the arm to the central longitudinal axis of the bar.

3. The method of claim 1, wherein each said contoured rim is shaped to form a said arm generally tapered in the direction from a free end of the arm to the central longitudinal axis of the bar.

4. A rolled steel bar formed by the method according to claim 1.

5. The method of claim 1, wherein at least one said roll assembly further comprises a bearing located each side of the roll through which the drive shaft extends.

6. The method of claim 5, wherein the roll stand further comprises a housing for containing the rolls, and wherein the roll positioner is a clamp assembly extending from said bearing located either side of the roll and connected to the housing by way of position adjusting screws.

7. The method of claim 1, wherein the roll stand further comprises a housing for containing the rolls, wherein the housing comprises a front wall having an inlet for the bar and a rear wall having an outlet for the bar, so that the pass line extends centrally through the inlet and outlet.

8. The method of claim 7, wherein the inlet and outlet are shaped to allow the rolls to extend partway there through.

9. The method of claim 1, wherein each said contoured rim has circumferentially extending outer flanges bordering a circumferentially extending inner recessed region having an apex, and wherein the rim has a circumferentially recessed groove located in the inner recessed region adjacent each outer flange, to thereby shape a bar having arms each having a bulbous or enlarged region at a free end thereof.

10. The method of claim 1, wherein the rolled bar has a property selected from the group consisting of:

(i) being made of steel alloy, stainless steel, coated steel, anodised steel, galvanised steel or ungalvanised steel; and (ii) a length of approximately 1 m to 3 m.

11. The method of claim 1, wherein the rolled bar has a radial length of each of said arms of approximately 10 mm to 40 mm.

12. The method of claim 1, wherein the rolled bar when viewed on end is generally Y-shaped, and the angle between two upstretched shorter arms of the 'Y' is between about 80 and 130 degrees.

13. The method of claim 1, wherein the rolled bar is a fence post.

14. The method of claim 1, wherein each said roll assembly further comprises a bearing located each side of the roll through which the drive shaft extends.

15. The method of claim 1, wherein one arm of the three interconnected arms of the rolled bar is radially longer than other arms of the three interconnected arms of the rolled bar.

* * * * *